United States Patent [19]

Westerlund

[11] 4,357,038

[45] * Nov. 2, 1982

[54] DOORCATCH

[76] Inventor: Allan G. Westerlund, Norrbackagaton 30, S-11341 Stockholm, Sweden

[ * ] Notice: The portion of the term of this patent subsequent to Oct. 14, 1997, has been disclaimed.

[21] Appl. No.: 162,497

[22] Filed: Jun. 24, 1980

Related U.S. Application Data

[63] Continuation-in-part of Ser. No. 918,417, Jun. 23, 1978, Pat. No. 4,227,727.

[30] Foreign Application Priority Data

Jun. 23, 1977 [SE] Sweden ..... 7707320

[51] Int. Cl.[3] ..... E05C 17/24

[52] U.S. Cl. ..... 292/270

[58] Field of Search ..... 292/268, 269, 270, 273, 292/274, 278

[56] References Cited

U.S. PATENT DOCUMENTS 79,550 7/1868 Cochrane ..... 292/268

4,227,727 10/1980 Westerlund ..... 292/278 X

*Primary Examiner*—Richard E. Moore

*Attorney, Agent, or Firm*—Birch, Stewart, Kolasch & Birch

[57] ABSTRACT

The present invention is directed to a doorcatch which performs the function of a safety chain for a door and includes a catch part. The catch part is connected to the doorframe and cooperates with a guide on a latch which is connected to the door. Both the catch part and the latch of the present invention are rotatable on horizontal axes. Further, the latch is free for movement up and down and is turnably attached to the door. In addition, the latch includes an axis or spindle arranged at such a level above an axis or spindle of the catch part and is mounted at a right-angled distance between the mounting plate of the catch part such that when the door is closed the parts which cooperate with the guide of the catch part automatically come into a notch. In this manner the catch part cooperates with the guide to automatically force the catch to a locked position when the door is closed either from the inside or from the outside. In another embodiment of the present invention the catch part may be positioned on a door and the latch positioned on a doorframe. This embodiment is utilized in combination with a door which swings inwardly.

4 Claims, 5 Drawing Figures

DOORCATCH

CROSS-REFERENCE TO RELATED APPLICATIONS

The present invention is a Continuation-In-Part of application Ser. No. 918,417, filed June 23, 1978, entitled "Doorcatch", now U.S. Pat. No. 4,227,727, issued Oct. 14, 1980.

BACKGROUND AND SUMMARY OF THE INVENTION

The present invention is directed to a catch adapted to be positioned between a door, covering an opening, and a doorframe, at the edge of the opening. The catch is designed for the same purpose as a conventional safety chain for a door. A catch part cooperates with a guide on a latch, and the catch part and latch are rotatably attached to the doorframe and the door, respectively. The catch part is provided with at least a part, cooperating with the guide, which part forms a catch part, preventing the removing of the catch part except at a recess in the inner end of the guide.

If a door is provided with a catch according to the present invention, the door can be opened from the outside, when the catch is in the inserted, operative, position. A person, who has the key, only needs to open the door a first time and push up the catch part of the catch so that the catch part comes out of engagement with the guide of the latch at the subsequent closing of the door.

The above-described maneuver is important to make it possible for the catch part to disengage from the guide. After that the door is opened a second time through which the catch is disengaged and the door can be opened totally.

Prior art catches have the disadvantage that they are not automatically forced into the catched position, when the door is closed from the outside.

This disadvantage is eliminated by the door catch according to the present invention. The catch part and the latch are rotatably mounted on horizontal axes, the latch is free to move up and down and is turnably attached on the door with its spindle arranged at such a level above the spindle of the catch part and at a right-angled distance between the mounting plate of the catch part. Further, the plane of rotation of the latch cooperates with the guide of the catch part, to automatically come into the notch, when the door is closed, and cooperates with the guide to automatically force the catch to a locked position, when the door is closed either from the inside or from the outside.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
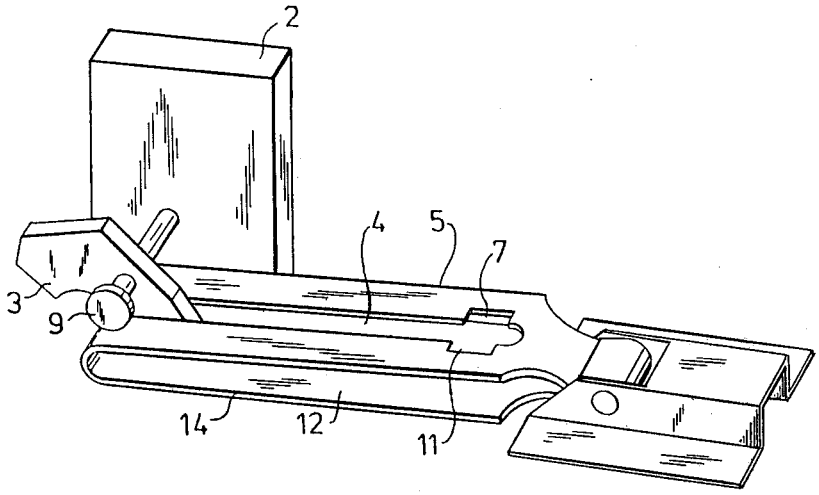
FIG. 1 shows a door catch according to the present invention, illustrated obliquely from above.
Figure 2:
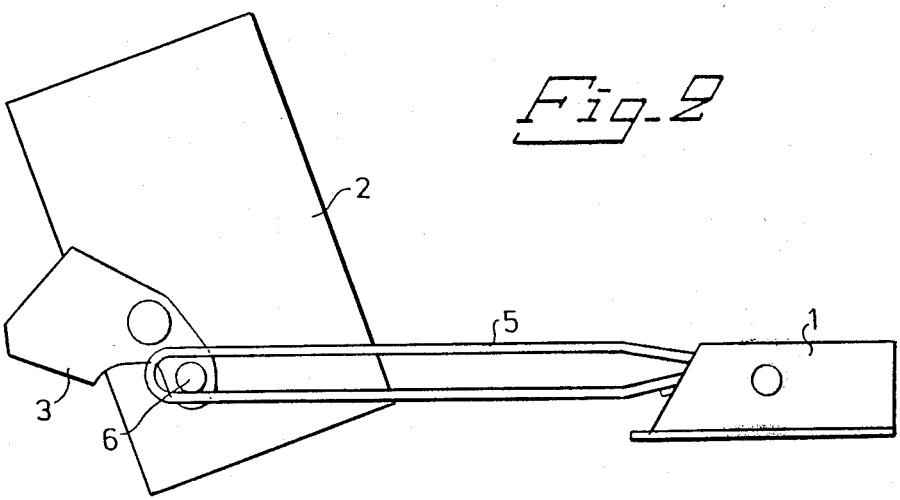
FIG. 2 shows the catch according to FIG. 1, illustrated from the side.

The catch according to FIGS. 1 and 2 is inserted between a door 1 and a doorframe 2 and is designed for the same purpose as the conventional safety chain of a door. The catch is provided with a catch part 3, which is attached to the doorframe 2. The catch part 3 is movable in a guide recess 4 on a latch 5, which is turnably attached to the door 1. The catch part 3 is provided with projecting parts 6, which form a catch device, which prevents the removing of the catch part 3 from the guide recess 4 except in an inner turning position, where the guide recess 4 is provided with notches 7, which corresponds to the projecting parts 6 of the catch part 3.

Figure 3:
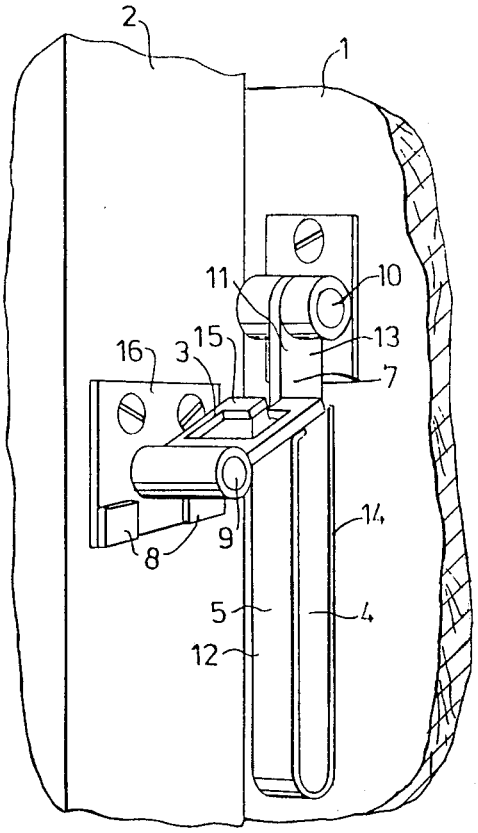
FIGS. 3 and 4 show two additional embodiments of the catch, illustrated obliquely from the front side.
Figure 4:
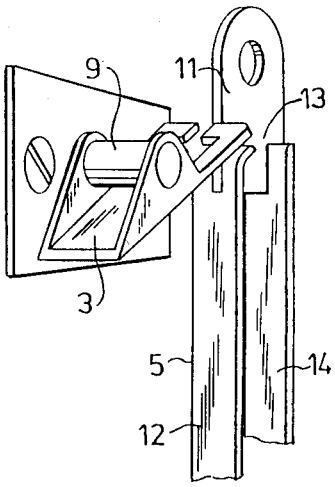

Two other examples of a catch according to the invention are shown in FIGS. 3 and 4. The catch part 3' is connected to the doorframe 2' in the same way as is shown in FIGS. 1 and 2 and is turnably arranged on a spindle 9'. Furthermore, the latch 5' which is attached on the door 1', is formed as an U, provided with U-branches 12', 14', bent towards each other, which one by one can be clasped by the catch part 3'. When the latch 5' is moved so that the catch part 3' has come to an inner turning position on the latch 5', it is provided with notches 7' so that the catch part 3' can be removed from the latch 5' and thus the door can be opened wholly. As illustrated in FIG. 3, the latch 5' is mounted on a spindle 10. The spindle 10 is affixed to the door 1' by means of a mounting bracket.

In this inner turning position the catch part 3' also is inserted on the latch 5', as shown in FIGS. 3 and 4. This insertion occurs automatically because, as shown in FIG. 3, the catch part 3' is kept in a horizontal position by the lip 8 positioned close to the spindle 9' on the doorframe 2', so that the studs 15 of the catch part 3', which are insertable into the guide recess 4', may be raised to meet the notches 7' of the latch 5' and fall in between the branches 12', 14' of the latch 5', as the door 1' is closed. As illustrated in FIG. 3, the mounting bracket 16 is positioned on the doorframe 2'. The spindle 9' is fixed to the bracket 16 and extends orthogonally relative to the doorframe 2'.

As the door 1' is opened and catched, if the latch 5' is raised over the spindle 9' by means of an individual's finger and the door is closed, the catch will open, such that the door 1' can be wholly opened.

As illustrated in FIGS. 3 and 4, the latch 5' according to the second embodiment of the invention, is formed with two opposed branches, an upper branch 12' and a lower branch 14', which are connected to each other at one end. The part of the catch part 3', which cooperates with the guide is formed as studs 15, automatically insertable in the space between the branches 12', 14'. As the door 1' is closed with the latch 5' freely hanging down, the studs 15 are raised by a part of the upper branch 12′ of the latch 5′, which goes up towards the port 11′ of the notches 7′, and is brought into the guide recess 4′.

As illustrated in FIGS. 1 and 2, the latch 5 according to the first embodiment of the invention is formed with two pairs of branches 12, 14, with each being connected to each other at one end. It is also seen, that the guide on this latch 5 is formed as guide recesses 4 on the latch 5. The notch 7 of the guide recess 4 on the latch 5 is formed with a port 11 on the upper branch 12 of the latch 5. This port is so arranged, that it lies at a higher level than the level of part 6 of the catch part 3 cooperating with the guide recess 4 lies on at the beginning of the automatic locking of the catch. At total closing of the door 1 the port 11 of the catch part 3 meets the upper branch 12 of the latch 5 somewhat below the notch 7 of the guide recess 4. Thus the ratchet part 3 is turned in a counter clockwise direction from its balance position in such a way, that the part 6 automatically is forced into notches 7 and down into the guide recess 4, when the balance position is recovered.

From FIGS. 3 and 4 it is also seen, that as the catch part 3′ is turned down on the back lip 8 and the door is closed, the part of the upper branch 12′ which slopes towards the port 11′ comes into engagement with the studs 15 of the catch part 3′ in such a way, that the studs 15 are raised and brought adjacent to the port 11′ and fall down into engagement with the guide recess 4′ between the branches 12′, 14′ of the latch 5′. The catch according to these two other examples of the invention is in this way automatically locked at the closing of the door 1′ in the same way as in the example according to FIGS. 1 and 2.

From FIGS. 3 and 4 it is also seen, that according to the two other embodiments of the invention the notches 7′ in the guide recess 4′ between the branches 12′, 14′ of the latch 5′ are formed with an open portion 13 also in the lower branch 14′ of the latch 5′. This open portion 13 is arranged so that, as the latch 5′ is turned out to a horizontal level, it lies nearly straight below the port 11′ in the upper branch 12′ of the latch 5′. Thus, the catch part 3′ is automatically releasable from the latch 5′ as the door 1′ is opened from the outside and the latch 5′ is raised above the spindle 9′ of the catch part 3′ and followed by the closing of the door 1′. If the door 1′ is opened once more, the catch is automatically opened, so the door 1′ can be opened totally.

Figure 5:
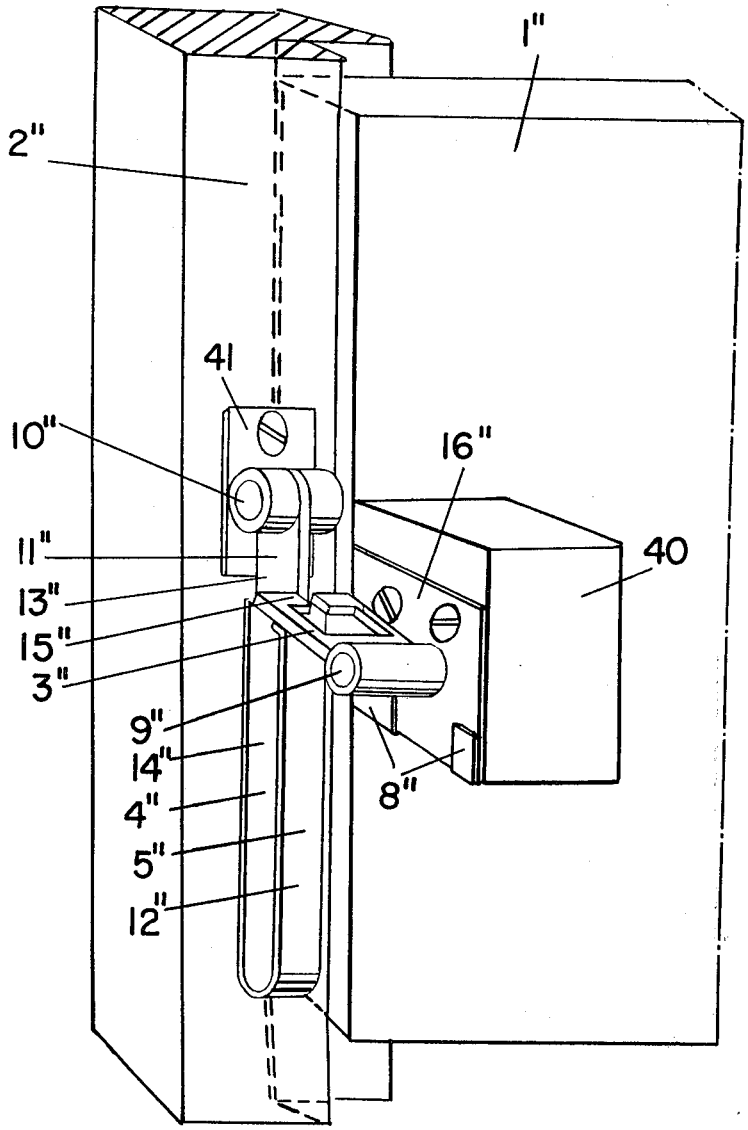
FIG. 5 shows an additional embodiment of a door catch illustrated in combination with a door which opens inwardly.

FIG. 5 illustrates another embodiment of the present invention wherein the catch mechanism is positioned on a door which swings inwardly. As illustrated in FIG. 5, the mounting bracket 16″ is mounted on a block 40 attached to the door 1″. A spindle 9″ is fixed to the mounting bracket 16″ and extends outwardly from the mounting block 40. A catch part 3″ is rotatably mounted on the spindle 9″ and includes a guide which is formed by studs 15″. In addition, lips 8″ are affixed to the mounting bracket 16″ and engage the spindle 9″ so that the studs 15″ of the catch part 3″ is maintained in a horizontal position.

A latch 5″ is affixed to the doorframe 2″ by means of a mounting bracket 41. The mounting bracket 41 includes a spindle 10″. The latch 5″ is rotatably mounted on the spindle 10″.

The latch 5″ according to the third embodiment of the present invention, is formed with two opposed branches, an upper branch 12″ and a lower branch 14″, which are connected to each other at one end. Adjacent to the portion of the latch 5″ which is rotatably mounted on the spindle 10″ is a port section 11″. The port section 11″ is defined by an open portion 13″ formed adjacent the upper ends of the branches 12″ and 4″. This open portion 13″ is arranged so that, as the latch 5″ is turned out to a horizontal level, it lies nearly straight below the port 11″ in the upper branch 12″ of the latch 5″.

As illustrated in FIG. 5, when the catch part 3″ is turned down onto the back lip 8″ and the door is closed, the part of the upper branch 12″ which slopes towards the port 11″ comes into engagement with the studs 15″ of the catch part 3″ in such a way, that the studs 15″ are raised and brought adjacent to the port 11″ and fall down into engagement with the guide recess 4″ between the branches 12″, 14″ of the latch 5″. In this manner, the catch according to the third embodiments of the present invention is automatically locked at the closing of the door 1″ in the same way as in the two previous embodiments.

Similarly to the two previous embodiments of the present invention, the port 11″ in the guide recess 4″ between the branches 12″, 14″ of the latch 5″ is formed with an open portion 13″ also in the lower branch 14″ of the latch 5″. This open portion 13″ is arranged so that as the latch 5″ is turned out to a horizontal level, by an individual's finger when the door 1″ is opened, it lies nearly straight below the port 11″ in the upper branch 12″ of the latch 5″. Thus, the catch port 3″ is automatically releasable from the latch 5″ as the door 1″ is opened from the outside and the latch 5″ is raised above the spindle 9″ on the catch part 3″ and the door 1″ is subsequently closed. If the door 1″ is opened once more, the catch is automatically opened, so that the door 1″ can be opened totally.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A catch for use between a door and a doorframe comprising:

a catch part operatively cooperating with a guide on a latch, said catch part and latch being rotatably attached to the door and the doorframe, respectively;

said catch part including at least a portion which cooperates with the guide to prevent the removal of said catch part from said guide on said latch except at a recess in the inner end of the guide;

said catch part and said latch being rotatably mounted on horizontal axes;

said latch being mounted on a spindle attached to said doorframe for free up and down movement, and said spindle being arranged at a level above a spindle of said catch part and positioned at a right-angled distance between a mounting plate of said catch part and a central plane through the latch perpendicular to its horizontal axis when the door is closed, such that the portion of said catch part which cooperates with the guide of the latch automatically enters the recess when the door is closed, and cooperates with the guide to force the catch to a locked position automatically, whenever the door is closed either from inside or from outside the opening; and said recess of said guide of the latch including both a port for the catch part on one side of the upper part of the latch and with an opening for the catch part on the opposite side of the upper part of the latch, the opening being arranged to lie nearly straight below the port, when the latch is rotated to a substantially horizontal position, through which the catch part is automatically detachable from the latch at the opening of the door from outside by pushing up on the latch on the spindle of the catch part, followed by a closing of the door.

2. A catch according to claim 1, wherein said latch is formed with two opposed branches which are connected to each other at one end thereof, and said portion of the catch part, which cooperates with the guide, are studs, insertable in the space between the branches.

3. A catch according to claim 1, wherein said latch is formed with two pairs of branches which are continuously connected to each other at their ends, and the guide on said latch is a guide recess in the branches of the latch.

4. A latch for use between a door and a doorframe comprising:

a catch part being mounted for movement on said door;

a latch including a guide being rotatably mounted on said doorframe;

said catch part being operatively cooperative with said guide to prevent the removal of said catch part from said guide on said latch except at a recess in the inner end of the guide;

said latch being rotatably mounted on a horizontal spindle attached to said doorframe for free up and down movement, and said spindle being arranged at a level above the catch part and positioned at a right-angled distance between a mounting plate of said catch part and a central plane through the latch perpendicular to its horizontal axis when the door is closed, such that a portion of said catch part which cooperates with the guide of the latch automatically enters the recess when the door is closed, and cooperates with the guide to force the catch to a locked position automatically, whenever the door is closed either from inside or from outside the opening;

said recess of said guide of the latch cooperating with said catch part so that when the latch is rotated to a substantially horizontal position at the opening of the door from outside by pushing up on the latch thus moving the catch part upward the latch is automatically detachable from said catch part when the door is subsequently closed.

* * * * *